US010258132B2

(12) United States Patent
Leung

(10) Patent No.: US 10,258,132 B2
(45) Date of Patent: Apr. 16, 2019

(54) HAIR STYLING APPARATUS

(71) Applicant: Conair Corporation, Stamford, CT (US)

(72) Inventor: Anthony Kit Lun Leung, Hong Kong (CN)

(73) Assignee: Conair Corporation, Stamford, CT (US)

( * ) Notice: Subject to any disclaimer, the term of this patent is extended or adjusted under 35 U.S.C. 154(b) by 147 days.

(21) Appl. No.: 14/985,710

(22) Filed: Dec. 31, 2015

(65) Prior Publication Data

US 2017/0188681 A1 Jul. 6, 2017

(51) Int. Cl.

| | |
|---|---|
| ***A45D 1/00*** | (2006.01) |
| ***A45D 2/00*** | (2006.01) |
| ***A45D 1/04*** | (2006.01) |
| ***H05B 3/26*** | (2006.01) |
| ***H05B 3/28*** | (2006.01) |

(52) U.S. Cl.

CPC ..... *A45D 2/001* (2013.01); *A45D 1/04* (2013.01); *H05B 3/265* (2013.01); *H05B 3/283* (2013.01); *A45D 2001/004* (2013.01); *H05B 2203/003* (2013.01); *H05B 2203/013* (2013.01); *H05B 2203/014* (2013.01)

(58) Field of Classification Search

CPC ... A45D 1/04; A45D 1/00; A45D 1/06; A45D 1/08; A45D 1/14; A45D 2/001; A45D 2/04; A45D 7/02; A45D 2001/004; A45D 2001/00

See application file for complete search history.

(56) References Cited

U.S. PATENT DOCUMENTS

| | | | | |
|---|---|---|---|---|
| 2,074,629 | A | 3/1937 | Ungar | |
| 4,479,047 | A | 10/1984 | Khaja et al. | |
| 4,695,704 | A | 9/1987 | Andis | |
| 5,223,694 | A * | 6/1993 | Tsuji | A45D 1/04 132/118 |
| 5,664,588 | A | 9/1997 | Berry | |
| 5,810,026 | A | 9/1998 | Sham | |
| 6,029,677 | A | 2/2000 | Nanba et al. | |
| 6,554,000 | B2 | 4/2003 | Lin | |
| 6,604,532 | B1 | 8/2003 | McClendon et al. | |
| 6,667,462 | B2 | 12/2003 | Lo | |
| 6,920,886 | B2 | 7/2005 | McCambridge et al. | |

(Continued)

FOREIGN PATENT DOCUMENTS

| | | | |
|---|---|---|---|
| EP | 1980173 | A2 | 10/2008 |
| EP | 2181618 | B1 | 12/2011 |
| WO | 2009030941 | A2 | 3/2009 |

*Primary Examiner* — Rachel R Steitz

(74) *Attorney, Agent, or Firm* — Lawrence Cruz, Esq.; Ryan, Mason & Lewis, LLP

(57) ABSTRACT

A hair treatment or styling apparatus adapted to impart a straightening and/or curling effect on hair includes both a novel thermally conductive construction and heating assembly, which conveys thermal energy uniformly to all areas of the treatment head such that the desired style is achieved regardless of the skill of the user. The apparatus further includes a hinge assembly incorporating one or more ceramic bearings units which provide smooth consistent resistance for pivoting movement of the treatment members and a more durable hinge joint thereby increasing the life and usability of the apparatus.

21 Claims, 8 Drawing Sheets

(56) References Cited

U.S. PATENT DOCUMENTS

| | | | | |
|---|---|---|---|---|
| D511,023 | S | 10/2005 | Cho | |
| 7,044,139 | B2 | 5/2006 | Tong | |
| 7,150,283 | B2 | 12/2006 | McClendon et al. | |
| D586,038 | S | 2/2009 | Kim | |
| D609,400 | S | 2/2010 | Yang | |
| 7,681,282 | B2 | 3/2010 | Liu | |
| RE41,321 | E | 5/2010 | Okumoto et al. | |
| 7,730,895 | B2 | 6/2010 | Maddocks et al. | |
| D619,760 | S | 7/2010 | Cheung | |
| 7,800,020 | B2 | 9/2010 | Ceva | |
| D627,511 | S | 11/2010 | Kim | |
| D627,515 | S | 11/2010 | Kim | |
| D627,925 | S | 11/2010 | Nenadich | |
| D632,429 | S | 2/2011 | Kim | |
| 7,947,933 | B2 | 5/2011 | Nagasako et al. | |
| D641,927 | S | 7/2011 | Kim | |
| 8,013,274 | B2 | 9/2011 | Suzuki et al. | |
| 8,035,061 | B2 | 10/2011 | Jung | |
| 8,066,016 | B2 | 11/2011 | Henninger et al. | |
| D650,941 | S | 12/2011 | Sidebotham | |
| 8,080,764 | B2 | 12/2011 | Shami et al. | |
| 8,082,929 | B2 | 12/2011 | Kim | |
| D651,743 | S | 1/2012 | Kim | |
| 8,232,505 | B2 | 7/2012 | Hottenrott et al. | |
| 8,286,645 | B2 | 10/2012 | Kyu et al. | |
| D672,088 | S | 12/2012 | Julemont | |
| D672,089 | S | 12/2012 | Julemont | |
| 8,336,561 | B2 | 12/2012 | You | |
| 8,420,980 | B2 | 4/2013 | Takenouchi | |
| D682,468 | S | 5/2013 | Kim | |
| 8,455,796 | B2 | 6/2013 | Leung | |
| 8,471,179 | B2 | 6/2013 | Takenouchi | |
| 8,530,794 | B2 | 9/2013 | Shami et al. | |
| 8,541,715 | B2 | 9/2013 | Overend et al. | |
| 8,567,415 | B2 | 10/2013 | Morgandi et al. | |
| 8,604,396 | B2 | 12/2013 | Takenouchi | |
| 8,776,805 | B2 | 7/2014 | deGrood | |
| D716,497 | S | 10/2014 | Renault | |
| 8,955,526 | B2 | 2/2015 | Smith | |
| D726,964 | S | 4/2015 | Smith et al. | |
| 2005/0056631 | A1 | 3/2005 | Cha | |
| 2005/0121050 | A1* | 6/2005 | Cha | A45D 1/04 132/229 |
| 2006/0076032 | A1 | 4/2006 | Fung | |
| 2007/0119844 | A1 | 5/2007 | Lo et al. | |
| 2008/0011318 | A1 | 1/2008 | Wong | |
| 2008/0236609 | A1 | 10/2008 | Wong | |
| 2011/0004985 | A1 | 1/2011 | Aravamudan | |
| 2011/0007985 | A1 | 1/2011 | Getsy | |
| 2011/0108052 | A1* | 5/2011 | Morgandi | A45D 1/04 132/230 |
| 2011/0174331 | A1* | 7/2011 | Kim | A45D 1/06 132/229 |
| 2011/0233190 | A1 | 9/2011 | Kukino et al. | |
| 2011/0247646 | A1 | 10/2011 | Oh | |
| 2011/0259356 | A1 | 10/2011 | Barton et al. | |
| 2013/0098389 | A1* | 4/2013 | Uwano | A45D 1/04 132/269 |
| 2013/0213430 | A1 | 8/2013 | Takenouchi | |
| 2013/0240498 | A1 | 9/2013 | Tang | |
| 2014/0042149 | A1 | 2/2014 | Kamitani | |
| 2014/0202488 | A1 | 7/2014 | Rivola et al. | |
| 2015/0122792 | A1 | 5/2015 | Moore et al. | |
| 2015/0136169 | A1 | 5/2015 | Moore et al. | |

* cited by examiner

HAIR STYLING APPARATUS

BACKGROUND

1. Technical Field

The present disclosure relates to an apparatus for treating hair, and, in particular, relates to an apparatus adapted to impart both a straightening and curling effect on a subject's hair. The apparatus further relates to an apparatus with a dual ceramic heating assembly and metallic construction, which distributes thermal energy to all areas of the treatment head whereby hair straightening and curling capabilities are enhanced.

2. Background of the Related Art

Heated hair may be smoothed, manipulated, and styled more easily that non-heated hair. There are numerous hair styling tools and appliances for heated styling of hair including hair straightener and curling irons apparatuses with each having a variety of features. Hair straightener apparatuses typically include two pivotal handles which are hinged at one end and pivot about the hinge between open and closed positions. Heating heads extend from each handle and have inner surfaces comprised of a heatable material, usually metal, for straightening or styling hair. An electric heater element located beneath each heatable surface is activated to warm the surfaces to a desired temperature. The inner surfaces are positionable around hair to be styled, and the hinged handles are moved to a closed position bringing the heated inner surfaces in contact with the hair. The gripped handles are then slid along the hair strands until the hair exits from the heads. One example of a hair straightener apparatus is disclosed in commonly assigned U.S. Pat. No. 7,178,532, the entire contents of which are incorporated by reference herein.

Curling irons are intended to impart a curl, wave or twist pattern to hair being styled by sufficiently heating a barrel or mandrel of the curling iron and restraining the hair in physical contact with the barrel. A section of hair is typically wound around the heated barrel of the curling iron and held in contact with the heated barrel for a period of time. Heat from the heated barrel reforms plastic bonds in the hair. When the heat styled hair is removed from the heated barrel, the hair generally retains the shape of the curling iron's barrel.

Conventional hair straighteners and curling irons have certain deficiencies which detract from their usefulness in performing multiple styling functions on a subject's head. For example, these apparatuses are ill suited to perform the dual function of hair straightening and hair curling. Reasons for this include insufficient heat distribution to the outer heating heads or mandrels, which may be a result of the construction, materials and/or the arrangement and configurations of the heating assemblies of these apparatuses.

SUMMARY

Accordingly, the present disclosure is directed to a hair treatment or styling apparatus adapted to impart both a straightening and/or curling effect on hair. The apparatus includes a novel thermally conductive construction and heating assembly, which conveys thermal energy uniformly to all areas of the treatment head such that the desired style is achieved regardless of the skill of the user. The apparatus further includes a hinge assembly incorporating one or more ceramic bearing units which provide smooth consistent resistance for pivoting movement of the treatment members and a more durable hinge joint thereby increasing the life and usability of the apparatus. The frame components of the styling apparatus are made from a metal, e.g. a stainless steel construction, which provides superior resistance to warping, shrinkage, expansion, etc. when subjected to various thermal energy levels in comparison to conventional models utilizing plastic components and parts.

In accordance with one embodiment, a hair styling apparatus includes a first member and a second member adapted for relative movement between an open position for receiving hair therebetween and an approximated position. The first and second members each include a handle and a treatment head. The treatment heads each include an inner plate segment to impart a straightening effect on hair and an outer shell segment configured to impart a curling effect on hair. The outer shell segments are formed of a thermally conductive metallic material. A heating assembly is associated with the inner plate segments of the first and second members whereby thermal energy is conveyed from the inner plate segments to the outer shell segments of the treatment heads.

In embodiments, the thermally conductive metallic material of the outer shell segments includes stainless steel. The handles of the first and second members each may include a handle cover, which is formed of a thermally conductive material. A handle insulator may be disposed between the handles and the treatment heads of the first and second members. The handle insulator includes an insulator material to reduce transfer of thermal energy from the treatment heads to the handles. In certain embodiments, a tip insulator may be disposed adjacent outer ends of each of the treatment heads. The tip insulators may include an insulator material to permit grasping of the outer ends by a user. The insulator material of the handle insulator and the tip insulator may include silicon.

In some embodiments, a manually manipulative lock switch is mounted to the first member. The manually manipulative lock switch may be movable between an unlocked position permitting movement of the first and second members to an open position and a locked position securing the first and second members in the approximated condition. One of the first and second members may include a lock hood and the other of the first and second members may include a lock pin. The lock hood is dimensioned to securely engage the lock pin when the lock switch is in the locked position and releases the lock pin when the lock switch is in the unlocked position. In certain embodiments, the lock hood has lock surfaces defining a recess whereby the lock pin is received within the recess and configured to engage the lock surfaces when the lock switch is in the locked position.

In some embodiments, each heating assembly of the first and second members includes a first ceramic heating plate and at least one ceramic substrate having a heating element mounted thereto. Each heating assembly of the first and second members may further include a second ceramic substrate in superposed relation with the first ceramic substrate and having a heating element mounted thereto. The heating element of each of the first and second ceramic substrates may include a resistive wire. The resistive wire may be printed on each of the first and second ceramic substrates. In some aspects, the resistive wire includes a plurality of longitudinal wire segments extending along a longitudinal axis of the first and second members and arranged in laterally spaced relation.

In embodiments, a hinge assembly is coupled to the first and second members to enable pivotal movement of the first and second members between the open position and the approximated position. The hinge assembly includes at least one hinge bearing, with the at least one hinge bearing comprising a ceramic material. In some embodiments, the hinge assembly includes first and second sets of hinge bearings mounted to the first member and the second member. Individual hinge bearings of each of the first and second sets comprise a ceramic material and are mounted to respective first and second members in contacting relation.

In an alternate embodiment, a hair styling apparatus includes first and second members configured to style hair, a hinge assembly coupled to the first and second members to enable pivotal movement between an open position for receiving hair therebetween and an approximated position. The hinge assembly includes at least one hinge bearing formed of a ceramic material and a heating element associated with at least one of the first and second members.

In embodiments, the hinge assembly includes a first hinge bearing mounted to the first member and a second hinge bearing mounted to the second member. The first and second hinge bearings include a ceramic material and are in contacting relation. The hinge assembly includes a third hinge bearing mounted to the first member and a fourth hinge bearing mounted to the second member. The third and fourth hinge bearings include a ceramic material and are in contacting relation, and are spaced from the first and second hinge bearings.

Other advantages of the present disclosure will be appreciated from the following description.

BRIEF DESCRIPTION OF THE DRAWINGS

Various embodiments of the present disclosure are described hereinbelow with references to the drawings, wherein.

DETAILED DESCRIPTION

Figure 1:
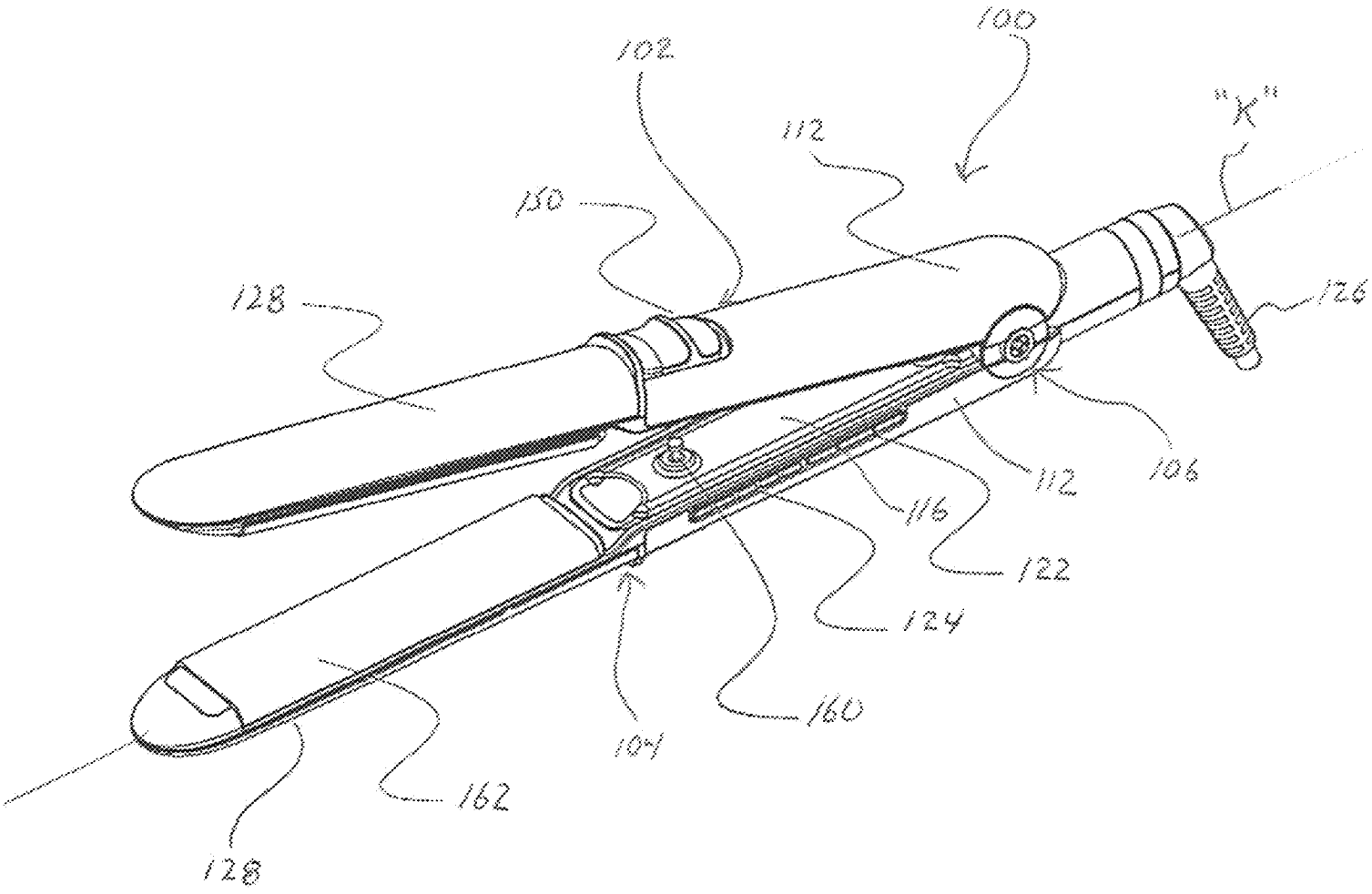
FIG. 1 is a perspective view of the hair styling apparatus in accordance with the principles of the present disclosure illustrating the first and second treatment members in an open condition.

Referring now in detail to the drawings and, in particular, to FIG. 1, the hair styling apparatus 100 in accordance with the principles of the present disclosure is illustrated. The hair styling apparatus 100 is operable between two modes, including a first hair straightening mode to impart a straightening effect on the hair of the subject and a second hair curling mode to impart a shaping, twisting or curling effect on the subject's hair.

The hair styling apparatus 100 includes first and second members 102, 104 connected to each other through a hinge assembly 106. The segment or section of the first and second members 102, 104 adjacent the hinge assembly 106 and which is engaged by the user defines the handle segment or "handle" of the apparatus while the segment or section remote from the hinge assembly 106 which styles the hair defines the "treatment head" of the apparatus 100.

The hinge assembly 106 typically incorporates a spring (not shown) to normally bias the first and second members 102, 104 to the open position depicted in FIG. 1. The first and second members 102, 104 are adapted to pivot about the hinge assembly 106 between open and approximated positions. As discussed hereinabove, the hinge assembly 106 includes one or more ceramic bearings which enhances the pivoting operation of the first and second members 102, 104 and increases the stability of the hinge joint thereby increasing the life and usability of the apparatus 100. Further details of the hinge assembly 106 will be discussed hereinbelow.

Figure 2:
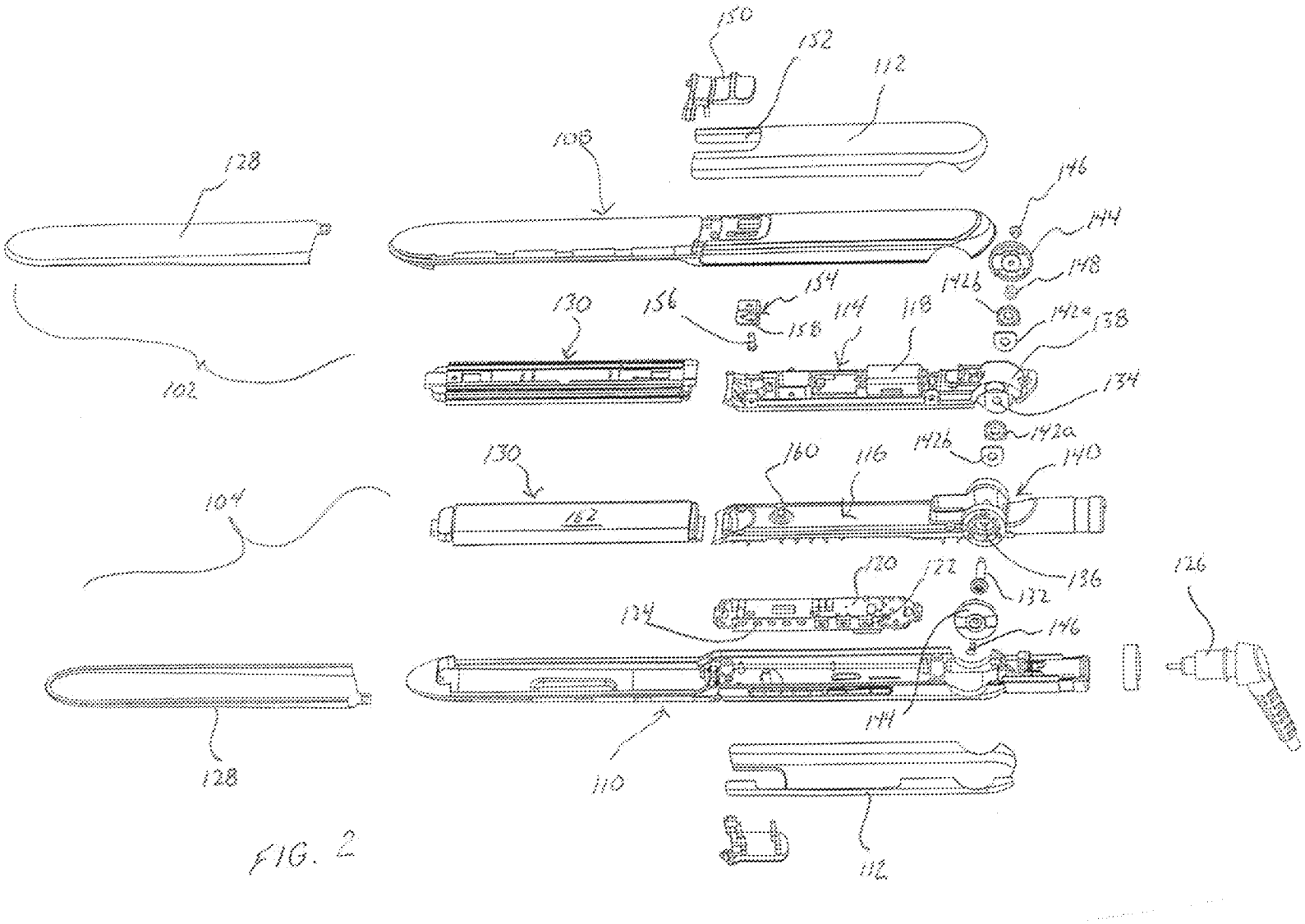
FIG. 2 is an exploded perspective view of the hair styling apparatus.

With reference to FIG. 2, in conjunction with FIG. 1, the first and second members 102, 104 include respective first and second housing members 108, 110 extending along a longitudinal axis "k" (FIG. 1) of the apparatus 100. Each of the first and second housing members 108, 110 has an outer handle cover 112 mounted thereto adjacent the hinge assembly 106 and dimensioned for engagement by the user. The outer handle covers 112 may be formed in whole, or in part, of stainless steel. The first and second housing members 108, 110 further include respective first and second inner handle frames 114, 116 with the first handle frame 114 incorporating an electrical component 118 such as a rheostat or electrical connector, and the second handle frame 116 having a control or circuit board 120. The control or circuit board 120 may include a controller/processor for controlling operation of the apparatus 100. The second housing member 110 may include an a plurality of control buttons 122 in electrical communication with the control board 120 for controlling operation of the apparatus 100, including temperature control, duration of treatment time, etc., and also include at least one or more indicator lights, e.g., LEDS 124 for providing visual indicia when the power is activated. A power cord 126 extends from the second housing member 110 for connection to a suitable electric outlet. Alternatively, the apparatus 100 may include a rechargeable battery.

Referring still to FIGS. 1-2, each of the first and second housing members 108, 110 has an outer shell 128 mounted thereto via conventional means within the treatment head segment of the apparatus 100. Each outer shell 128 may include a slight arcuate profile. The outer shells 128 may be formed in whole, or in part, of a thermally conductive material such as stainless steel. Similarly, the first and second housing members 108, 110 may be formed in whole, or in part, of stainless steel. Each of the first and second housing members 108, 110 further include a heating assembly 130 mounted within the interior surface of the housing members 108, 110. The heating assemblies 130 each include multiple ceramic heating elements/substrates. Further details of the heating assemblies 130 and the significance of the stainless steel construction of the first and second housing members 108, 110 and the outer shells 128 will be discussed in greater detail hereinbelow.

Figure 4:
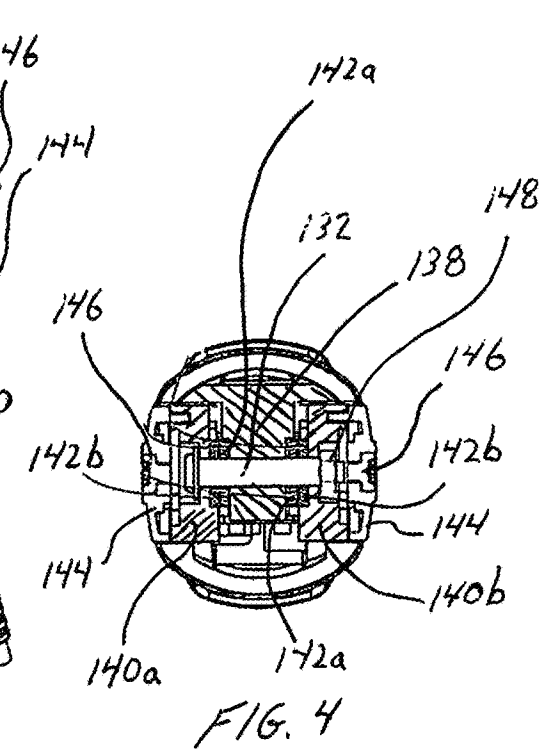
FIG. 4 is an axial cross-sectional view illustrating the components of the ceramic hinge assembly mounted within the handle of the hair styling apparatus.
Figure 3:
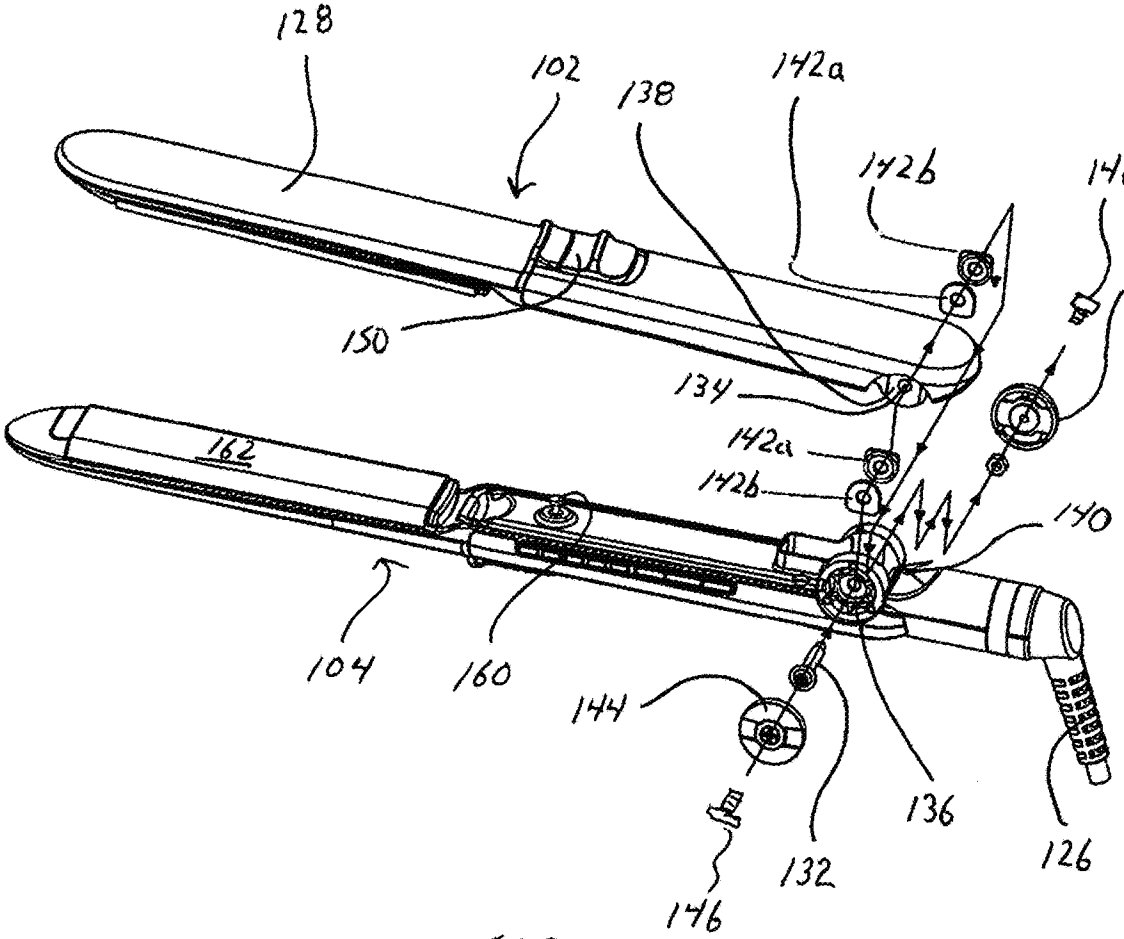
FIG. 3 is a perspective view with parts separated illustrating the components of the ceramic hinge assembly of the hair styling apparatus.

Referring now to FIGS. 3-4, in conjunction with FIG. 2, the hinge assembly 106 will be discussed. The hinge assembly 106 includes a hinge pin or axle 132 which extends through openings 134, 136 of hinge mounts 138, 140 of the first and second inner handle frames 114, 116 of the first and second members 102, 104 respectively. The hinge mount 138 may include a single post or column while the hinge mount 140 may include a pair of spaced posts or columns 140*a*, 140*b* (FIG. 4). The single post of the hinge mount 138 is disposed or received within the spaced columns 140*a*, 140*b* of the hinge mount 140 upon coupling of the hinge assembly 106 as best depicted in FIG. 4. The hinge assembly 106 further includes two sets of bearings 142*a*, 142*b* disposed between the hinge mounts 138, 140, i.e., on each side of the hinge mount 138. The bearings 142*a* of each set are mounted or engaged with the hinge mount 138 of the first member 102 and the bearings 142*b* are mounted or engaged with the respective columns 140*a*, 140*b* of the second hinge mount 140 of the second member 104. The bearings 142*a*, 142*b* are in contacting relation and provide the surfaces about or along which the first and second members 102, 104 pivot.

The bearings 142*a*, 142*b* are formed of a ceramic material. The use of a ceramic material within the hinge assembly 106 provides very smooth, consistent resistance for relative pivoting movement of the first and second members 102, 104 thereby providing a much stronger and stable hinge joint as compared to conventional units utilizing plastic or metallic hinge elements. The ceramic material or bearings incorporated within the hinge assembly 106 increases the overall life of the hair styling apparatus 100 by permitting unlimited pivotal action of the first and second members 102, 104 with minimal wear and tear on the bearings 142*a*, 142*b*. The hinge assembly 106 further includes hinge covers 144 with associated fasteners and/or nuts 146, 148 to enclose the hinge assembly 106.

Figure 6:
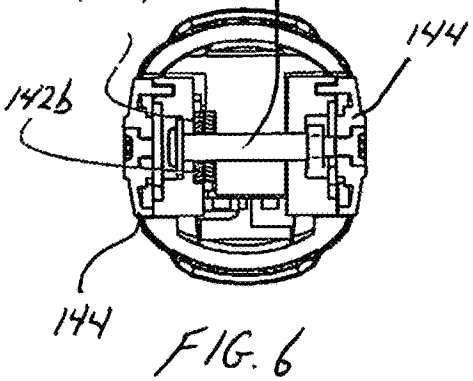
FIG. 6 is an axial cross-sectional view illustrating the components of the ceramic hinge assembly of FIG. 5 mounted within the handle of the hair styling apparatus.
Figure 5:
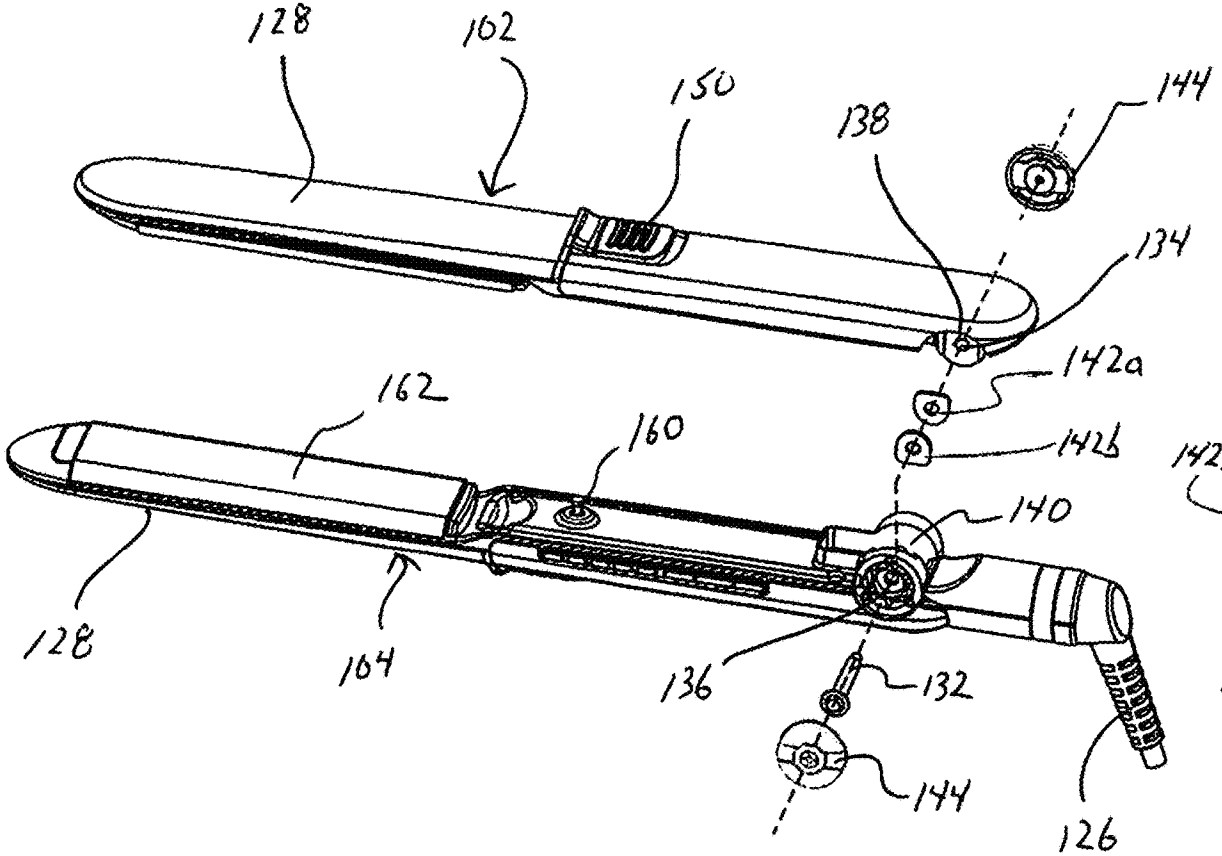
FIG. 5 is a perspective view with parts separated illustrating the components of an alternate ceramic hinge assembly of the hair styling apparatus.
Figure 7:
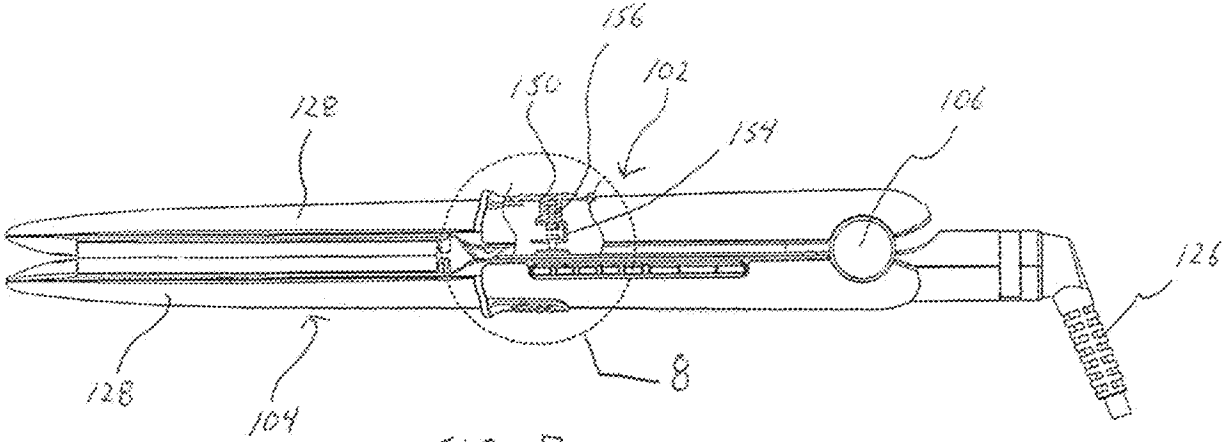
FIG. 7 is a side elevation view in partial cross-section of the hair styling apparatus illustrating the lock mechanism in an unlocked condition.
Figure 8:
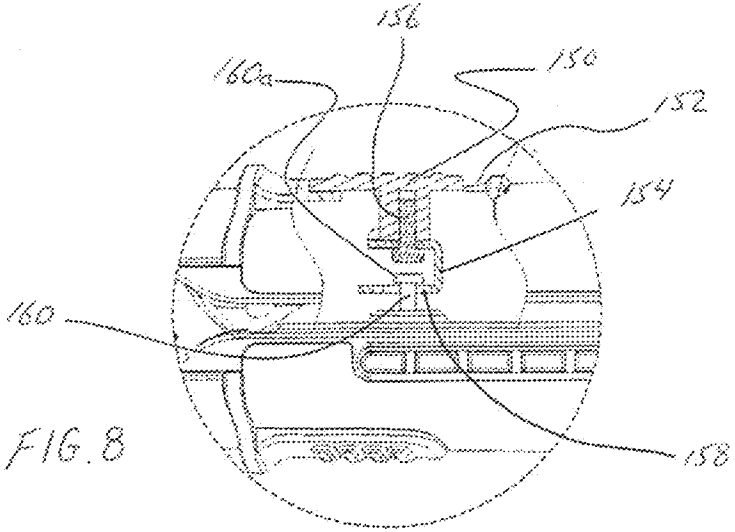
FIG. 8 is an enlarged view of the area of detail depicted in FIG. 7 illustrating the relationship of the lock switch, the lock pin and the lock hood of the lock mechanism in the unlocked condition.

FIGS. 5 and 6 illustrate an embodiment where only one set of ceramic bearings 142*a*, 142*b* may be incorporated within the hinge assembly 106. Due to the characteristics of the ceramic material, it is envisioned that one set of ceramic bearings 142*a*, 142*b* may provide sufficient support and smooth resistance to facilitate pivotal movement of the first and second members 102, 104 while also extending the life of the apparatus 100.

Figure 9:
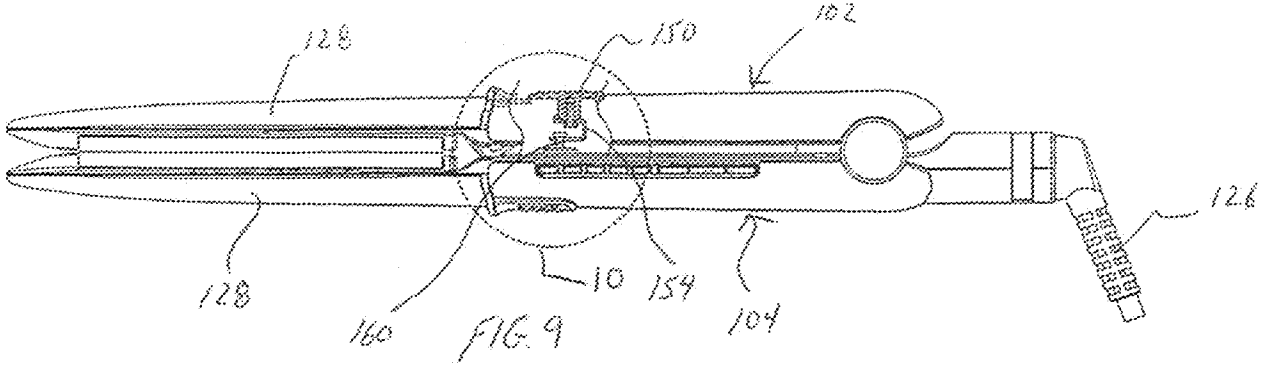
FIG. 9 is a view similar to the view of FIG. 7 illustrating the lock mechanism in a locked condition facilitating use of the hair styling apparatus in a curling function.
Figure 10:
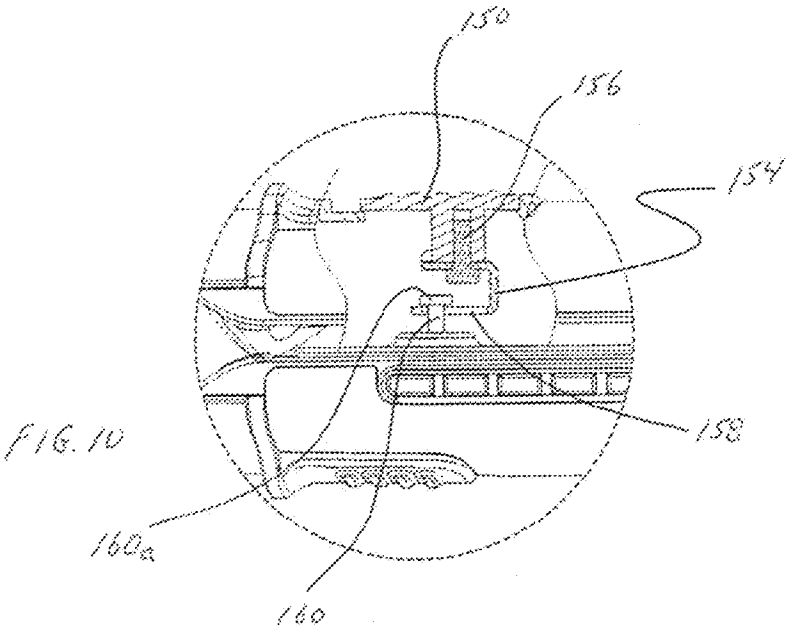
FIG. 10 is an enlarged view of the area of detail depicted in FIG. 9 illustrating the relationship of the lock switch, the lock pin and the lock hood of the lock mechanism in the locked condition.

Referring to FIGS. 1, 2 and 7-8, the hair styling apparatus 100 further includes a lock mechanism to secure the first and second members 102, 104 in the approximated condition when utilizing the apparatus 100 in a curling styling mode. The lock mechanism includes a lock switch 150 at least partially received within an opening 152 (FIG. 2) in the handle cover 112 of the first member 102. The lock switch 150 is secured to a generally U-shaped lock hood 154 through fastener 156. The lock hood 154 defines an elongated opening 158. The lock mechanism further includes a lock pin 160 depending outwardly from the second inner handle frame 116 of the second member 104. The lock pin 160 is received within the elongated opening 158 of the lock hood 154. In the unlocked position of the lock switch 150 (FIGS. 7 and 8) the lock pin 160 is aligned with the opening 158 of the lock hood 154 to permit the lock pin 160 to pass through the opening 158 thereby enabling the first and second members 102, 104 to move to the open position depicted in FIG. 1. Upon longitudinal movement of the lock switch 150 and the lock hood 154 to the locked position depicted in FIGS. 9-10, the lock pin 160 is misaligned with the opening 158 such that the enlarged pin head 160*a* of the lock pin 160 engages the surfaces of the lock hood 154 defining the opening 158 in secured relation therewith. In this position, the first and second members 102, 104 are prevented from undergoing pivotal movement, thereby securing the first and second members 102, 104 in a curling iron mode, i.e., where the first and second members 102, 104 may be utilized to curve hair around the outer shells 128.

Figures 11, 12:
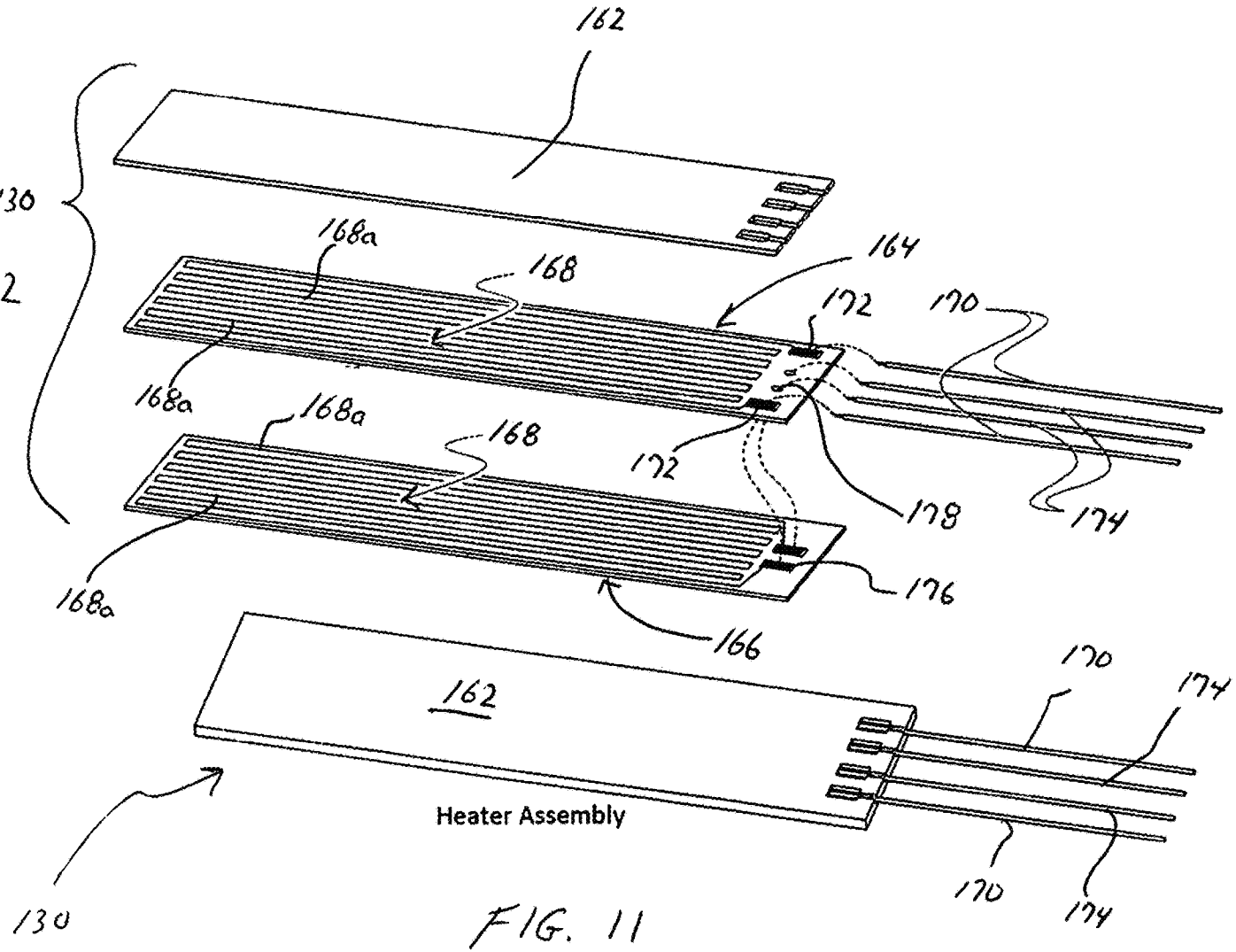
FIG. 11 is a perspective view of the dual ceramic heating assembly mounted within each of the first and second treatment members.
FIG. 12 is an exploded perspective view of the dual ceramic heating assembly of FIG. 11.

Referring now to FIGS. 11-12, in conjunction with FIG. 2, the dual ceramic heating assemblies 130 within the treatment head of the apparatus 100 will be discussed. Each heating assembly 130 includes an inner heating plate 162 and first and second ceramic substrates 164, 166 in superposed relation with respect to the heating plate 162. The heating plate 162 is substantially planar; however, the heating plate 162 may include an arcuate profile depending on the intended use of the apparatus 100. The heating plate 162 is comprised of a ceramic material. The first and second ceramic substrates 164, 166 each include at least one wire resistor 168, printed on, embedded within, or mounted to, each surface of the ceramic substrates 164, 166. The wire resistor 168 includes a plurality of longitudinally extending and spaced resistor segments 168*a* extending along a majority of the length of the respective first and second substrates 164, 166 to encompass substantially the entire surfaces areas of the first and second ceramic substrates 164, 166. The first ceramic substrate 164 is electrically connected to the power source through first and second lead wires 170 and contacts 172 electrically coupled to the resistor 168. Similarly, the second ceramic substrate 166 is electrically connected to the power source through third and fourth lead wires 174 and contacts 176. The third and fourth lead wires 174 extend through openings 178 of the first ceramic substrate 164 to engage the contacts 176.

The provision and arrangement of the first and second ceramic substrates 164, 166 with associated wire resistors 168 maximizes the surface area heated and the thermal energy conveyed to the heating plates 162 (e.g., the ceramic heating plates 162). Moreover, the relative thin profile of the ceramic substrates 164, 166 facilitates transfer of thermal energy to the heating plates 162 without the energy loss inherent in larger volume conventional steel or aluminum heaters. In addition, as will be discussed hereinbelow, the dual ceramic heating assemblies 130 enhance heat transfer to the stainless steel outer shells 128 of the first and second members 102, 104, which facilitates use of the apparatus 100 during the curling mode.

The use of the styling apparatus 100 for imparting a straightening effect on hair will now be discussed. In use, the apparatus 100 is activated, and hair is positioned between the heating plates 162 of the heating assemblies 130 of each of the first and second members 102, 104 when in the open position of FIG. 1. The first and second members 102, 104 are moved to the approximated position of FIG. 7. In one embodiment, electrical contacts (not shown) associated with the first and second members 102, 104 may engage and activate the heating assemblies 130. The apparatus 100 is maneuvered to drag the hair between the heating plates 162 to straighten the hair. When it is desired to utilize the apparatus 100 in a curling mode, the lock switch 150 is moved from the unlocked position of FIGS. 7-8 to the locked position of FIGS. 9-10 and the apparatus 100 is manipulated to wrap the hair about the outer shells 128 of the first and second members 102, 104. As discussed in detail hereinabove, the dual ceramic substrate and ceramic heating plate of each heating assembly 130 produces a substantial amount of thermal energy which is conveyed (with minimal heat loss) to the highly conductive (e.g., thermal) stainless steel outer shells 128 of the first and second housing members 108, 110. It is noted that the first and second housing members 108, 110 are fabricated from stainless steel and also may conduct thermal energy to the outer shells 128. The outer shells 128, which are at an appropriate temperature to plasticize and shape hair, are utilized to impart a curling or wave effect to the hair.

Figure 13:
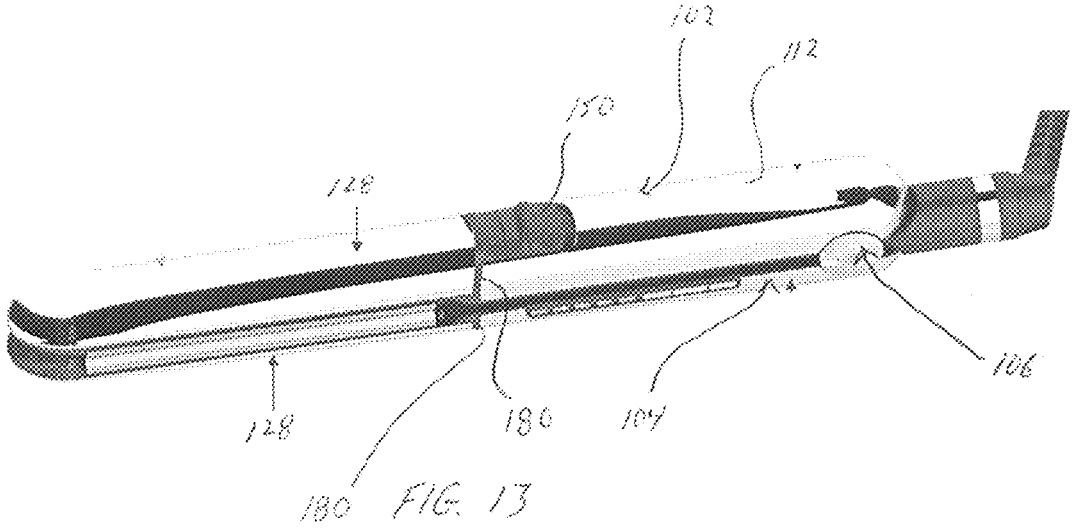
FIG. 13 is a perspective view of an alternate embodiment of the hair styling apparatus.
Figure 14:
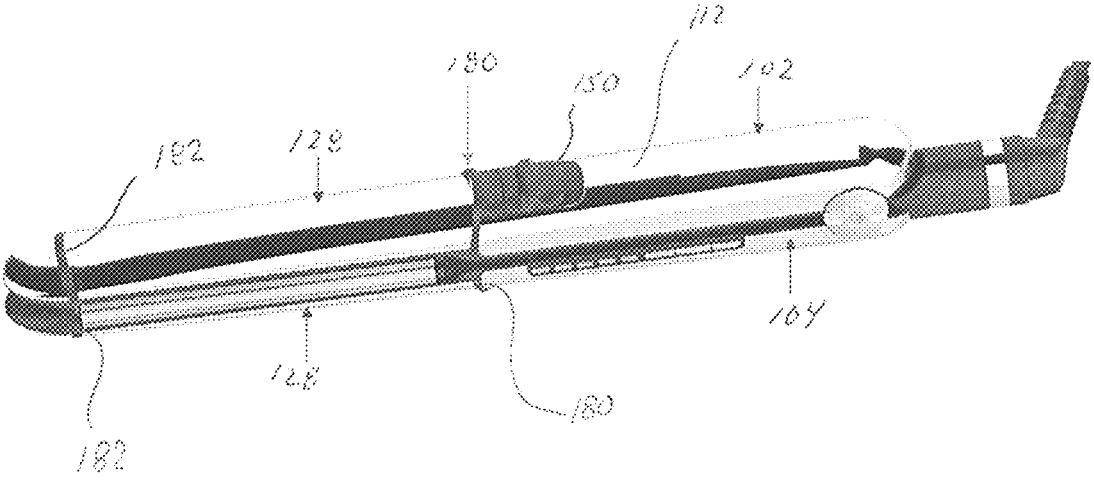
FIG. 14 is a perspective view of another alternate embodiment of the hair styling apparatus.

FIGS. 13-14 illustrate additional or alternate features of the present disclosure. The styling apparatus 100 of FIG. 13 includes proximal cooling ridges or handle insulators 180 which may be mounted at the end of the handle of the styling apparatus 100, e.g., between the handle covers 112 and the outer shells 128 of each of the first and second members 102, 104, or alternatively be mounted about the respective peripheries of either the handle covers 112 or the outer shells 128. As a further option, the handle insulators 180 may be received within grooves defined within the peripheries of either handle covers 112 or the outer shells 128. The handle insulators 180 may be fabricated from a heat insulator material such as, e.g., silicon, and may be band-like in configuration extending relative to the periphery of the respective first and second members 102, 104. The handle insulators 180 each substantially prevent conveyance of thermal energy from the treatment head of the apparatus 100, e.g., from the outer shells 128 to the handle covers 112 to protect the user. In FIG. 14, the apparatus 100 incorporates a second or tip insulator 182 adjacent each of the ends of the first and second members 102, 104 remote from the hinge assembly 106. The tip insulators 182 may be similar in construction and function to the handle insulators 180 and serve to insulate the end of the first and second members 102, 104, e.g., disrupt thermal conductivity to the ends. In this manner, the user may grasp or pinch the ends of the first and second members 102, 104 while holding the handle with the remaining hand during operation of the apparatus 100 to facilitate maneuverability. The tip insulators 182 may be mounted about the outer shells 128 spaced from the extreme ends of the first and second members 102, 104 and/or may at least partially extend between the inner and outer surfaces of the outer shells 128, e.g., be received within respective grooves in the outer shells 128.

The styling apparatus 100 of the present disclosure provides significant benefits over known devices. Firstly, the styling apparatus 100 is readily convertible for use as a hair straightener or a hair curler. The frame components including the first and second housing members 108, 110, the handle covers 112, the first and second inner handle frames 114, 116 and the outer shells 128 may be entirely formed of stainless steel which significantly improves the life of the apparatus 100 while also providing a more robust device compared to conventional partially plastic units. The dual ceramic heating assemblies 130 provide an effective, efficient and uniform transfer of thermal energy to the internal heating plates 162 during a hair straightening mode of the apparatus 100, and to the outer stainless steel outer shells 128 during a hair curling mode of the apparatus 100. The ceramic hinge assembly enhances smooth and unencumbered pivoting movement of the first and second members 102, 104 and provides a more durable hinge joint further increasing the life and usability of the apparatus.

The above description and the drawings are provided for the purpose of describing embodiments of the present disclosure and are not intended to limit the scope of the disclosure in any way. It will be apparent to those skilled in the art that various modifications and variations can be made without departing from the spirit or scope of the disclosure. Thus, it is intended that the present disclosure cover the modifications and variations of this disclosure provided they come within the scope of the appended claims and their equivalents.

What is claimed is:

1. A hair styling apparatus, which comprises:

a first member and a second member adapted for relative movement between an open position for receiving hair therebetween and an approximated position, said first and second members each including a handle and a treatment head, said treatment heads each including an inner plate segment to impart a straightening effect on hair and an outer shell segment configured to impart a curling effect on hair, said outer shell segments being formed of a thermally conductive metallic material; and a heating assembly associated with each of said inner plate segments of said first and second members whereby thermal energy is conveyed from said inner plate segments to said outer shell segments of said treatment heads, each said heating assembly including a heating plate and first and second substrates mounted in superposed relation with respect to each other and said heating plate, each said first and second substrates having a heating element mounted thereto such that the heating elements of each said heating assembly are also disposed in superposed relation with respect to each other and said heating plate, said first and second substrates of each said heating assembly being in direct contacting relation.

2. The hair styling apparatus according to claim 1 wherein said thermally conductive metallic material of each said outer shell segments includes stainless steel whereby at least one of the degree and rate of expansion of said outer shell segments when subjected to thermal energy generally to corresponds said at least one of the degree and rate of expansion of said inner plate segments thereby maintaining positioning of said outer shell segments relative to said inner plate segments.

3. The hair styling apparatus according to claim 2 wherein said handles of said first and second members each include a handle cover, said handle covers being formed of a thermally conductive material.

4. The hair styling apparatus according to claim 3 including a handle insulator disposed between said handles and said treatment heads of said first and second members, said handle insulator including an insulator material to reduce transfer of thermal energy from said treatment heads to said handles.

5. The hair styling apparatus according to claim 4 including a tip insulator disposed adjacent outer ends of each said treatment heads, said tip insulators including an insulator material to permit grasping of said outer ends by a user.

6. The hair styling apparatus according to claim 5 wherein said insulator material of said handle insulator and said tip insulator includes silicon.

7. The hair styling apparatus according to claim 1 including a manually manipulative lock switch mounted to said first member, said lock switch movable between an unlocked position permitting movement of said first and second members to an open position and a locked position securing said first and second members in said approximated condition.

8. The hair styling apparatus according to claim 7 wherein one of said first and second members includes a lock hood and the other of said first and second members includes a lock pin, said lock hood securely engaging said lock pin when said lock switch is in said locked position and releasing said lock pin when said lock switch is in said unlocked position.

9. The hair styling apparatus according to claim 8 wherein said lock hood has lock surfaces defining a recess, said lock pin received within said recess and configured to engage said lock surfaces when said lock switch is in said locked position.

10. The hair styling apparatus according to claim 1 wherein said heating element of each said first and second substrates includes a resistive wire.

11. The hair styling apparatus according to claim 10 wherein said resistive wire is printed on each said first and second substrates.

12. The hair styling apparatus according to claim 10 wherein said resistive wire includes a plurality of longitudinal wire segments extending along a longitudinal axis of said first and second members and arranged in lateral spaced relation.

13. The hair styling apparatus according to claim 1 including a hinge assembly coupled to said first and second members to enable pivotal movement of said first and second members between said open position and said approximated position, said hinge assembly including at least one hinge bearing, said at least one hinge bearing comprising a ceramic material.

14. The hair styling apparatus according to claim 13 wherein said hinge assembly includes first and second sets of hinge bearings mounted to said first member and said second members, individual hinge bearings of each said first and second set comprising a ceramic material and being mounted to respective first and second members in contacting relation.

15. The hair styling apparatus according to claim 1 wherein said heating plate of each said heating assembly includes a ceramic material.

16. The hair styling apparatus according to claim 15 wherein said first and second substrates of each said heating assembly includes a ceramic material.

17. The hair styling apparatus according to claim 16 wherein said first substrate of each said heating assembly is in contacting relation with said heating plate thereof.

18. A hair styling apparatus, which comprises:

a first member and a second member configured for relative movement between an open position for receiving hair therebetween and an approximated position, and extending along a central longitudinal axis, said first and second members each including an inner plate segment configured to impart a straightening effect on hair when said first and second members are in said approximated position and an outer shell segment; and a heating assembly associated with each of said inner plate segments of said first and second members, each said heating assembly including:

an inner heating plate configured and positioned to contact hair;

a first planar substrate having a first heating element and being mounted adjacent said inner heating plate; and a second planar substrate having a second heating element and being disposed radial outward of said first planar substrate with respect to said central longitudinal axis, and being in superposed contacting relation with said first planar substrate.

19. The hair styling apparatus according to claim 18 wherein said first planar substrate of each said heating assembly is in contacting relation with said inner heating plate thereof.

20. The hair styling apparatus according to claim 19 wherein said first and second substrates of each said heating assembly includes a ceramic material.

21. The hair styling apparatus according to claim 20 wherein said outer shell segment of each said first member and said second member is configured to impart a curling effect on hair, said outer shell segments each being formed of a thermally conductive metallic material, wherein thermal energy generated by said first and second heating elements is conveyed to said outer shell segments.

* * * * *